US005191664A

United States Patent [19]

Wyatt

[11] Patent Number: 5,191,664

[45] Date of Patent: Mar. 9, 1993

[54] WATERBED SHEET SECURING CLIP

[76] Inventor: Kent E. Wyatt, 1003 Longview Dr., #29, Rogers, Ark. 72756

[21] Appl. No.: 862,408

[22] Filed: Apr. 21, 1992

[51] Int. Cl.[5] ..... A47C 21/02

[52] U.S. Cl. ..... 5/498; 5/658; 24/72.5

[58] Field of Search ..... 5/496, 498, 504.1, 658; 24/72.5

[56] References Cited

U.S. PATENT DOCUMENTS 672,881 4/1901 Allen ..... 5/498 X
3,838,470 10/1974 May .
4,040,133 8/1977 Gilreath .
4,089,075 5/1978 May .
4,486,909 12/1984 McKneelan .
4,660,240 4/1987 Hutton et al. .
4,712,260 12/1987 Bissel ..... 5/451
4,782,543 11/1988 Hutton et al. .
5,014,399 5/1991 Grisel ..... 24/72.5
5,044,028 9/1991 Sleeth ..... 5/496 X

*Primary Examiner*—Michael F. Trettel
*Attorney, Agent, or Firm*—Brian D. Smith

[57] ABSTRACT

A device for holding bedding neatly in place on a waterbed is disclosed. The device is designed for use with a conventional waterbed having a fluid-filled mattress supported within a frame structure which is lined with waterproof plastic liner for preventing water from leaking out of the waterbed. The device includes a fastener for gripping an edge portion of a bedsheet and a positioning component for positioning the fastener at a location below the top surface of the fluid-filled mattress between the mattress and the waterbed liner. The positioning component is secured to the waterbed's frame structure without piercing the waterproof plastic liner.

5 Claims, 2 Drawing Sheets

WATERBED SHEET SECURING CLIP

BACKGROUND OF THE INVENTION

The present invention relates generally to waterbeds, and more particularly to a device for securing sheets and the like in place on a waterbed.

Most waterbeds have a sturdy flat bottom which supports a box-like frame made from wooden boards lying on edge and fastened together at the four corners of the frame. This structure contains and supports a fluid-holding mattress. The mattress is essentially a water-filled flexible bag, usually made of a sheet plastics material. Ordinarily, a heater maintains the water at a desired temperature and chemicals are used to prevent growth of algae within the mattress.

Because waterbeds provide a great deal of comfort and in their basic form are less expensive than conventional bedding, waterbeds are becoming increasingly popular. It is also recognized that the support provided by a waterbed is often more appropriate for a person suffering from arthritis or back ailments, and this factor also contributes to the increasing popularity of waterbeds.

A particular disadvantage of waterbeds, however, in comparison with conventional boxspring and mattress bedding, is that it is very difficult to hold the sheets in place along the edges and corners of the waterbed mattress. Although the bed may be made up neatly, as soon as one rests on the waterbed, the sheets begin to bunch up and pull away from the edges of the waterbed mattress.

The tendency for the sheets to come loose from a waterbed has been countered previously by using very large sheets with plenty of extra material that can be tucked under the mattress, by providing diagonal straps on the corners of a waterbed sheet, and by providing specially designed sheets including pockets at their corners for use on waterbeds. While such devices are useful on conventional mattresses, they fail to solve efficiently the problem of sheets coming loose from waterbeds.

The problem is particularly serious with top sheets. Accordingly, top and bottom sheets are sometimes provided as a sewn-together combination. While this helps solve the problem of the sheets becoming loose from the bed, it results in a bed sheet over 12 feet in length, which is very difficult to launder.

The above-described sheets designed particularly for waterbeds are also difficult to fit on waterbed mattresses, because of the great weight of the water contained in a waterbed mattress. In order to tuck a pocket portion of a waterbed sheet around a mattress corner, a considerable amount of water must be lifted. This usually requires that one bend over the bed, which is at best, an awkward and difficult task.

Other devices for holding waterbed sheets in place attach to the frame of the waterbed. U.S. Pat. Nos. 3,838,470 and 4,089,075 show two such devices, but these devices are not particularly well-adapted to being added to existing waterbeds. Another attempted solution to the problem uses frame attaching devices which interconnect with buttonholes provided in special waterbed sheets, as shown in U.S. Pat. No. 4,486,909 to McKneelen. U.S. Pat. No. 4,040,133 to Gilreath addresses the problem with a strap of plastic film having one end held under the mattress of a waterbed by the weight of the mattress for holding special sheets, etc., equipped with hook-and-loop fasteners of the well-known type available under the trademark Velcro.

Another device for holding ordinary flat sheets in place is disclosed in U.S. Pat. No. 4,660,240 to Hutton et al. Although this device would appear to work well, its installation requires a screw or similar fastener to pierce the liner of the waterbed frame, causing some reluctance to install the device.

Another device (also patented by Hutton in U.S. Pat. No. 4,782,543) for holding sheets in place on a waterbed utilizes a fastener for gripping the sheet and an elongate elastic connector attached to the fastener which is held in a desired location by a retainer member. The retainer member is placed beneath the waterbed mattress and held in place by friction and adhesion between the retainer and the liner and water-filled mattress. Under ordinary conditions of use, the device would appear to work as intended. However, under severe conditions of use, i.e. pulling hard on the sheets, the device could be pulled out of its position under the mattress since it is held in place only by friction and adhesion, i.e. it is not physically secured to the waterbed frame. It would also be difficult to install after the mattress is filled with water since it would require that one lift up the rather heavy water-filled corner of the waterbed mattress. The device is also only disclosed for use at the corners of a waterbed. It is not clear whether this device would work along the sides of a waterbed which is another problematic area where the sheets pull away from the mattress.

In view thereof, a need still exists for an inexpensive and easily installed device which can securely hold waterbed sheets in place along the sides of the waterbed, and whose installation does not require that the waterbed liner be pierced.

DISCLOSURE OF THE INVENTION

The present invention addresses the aforementioned needs by providing a device for holding bedding, particularly sheets, neatly in place on a waterbed. The waterbed is of the conventional type having a fluid-filled mattress supported within a frame structure which is lined with waterproof plastic liner for preventing fluid from leaking out of the waterbed if the mattress begins leaking. The device includes fastener means for gripping an edge portion of waterbed bedding and means for positioning the fastener means at a location below the top surface of the waterbed's fluid-filled mattress between the mattress and the waterbed liner. The positioning means is secured to the frame of the waterbed without piercing the waterbed's plastic liner.

In a preferred embodiment of the present invention, the means for positioning the fastener means below the top surface of the waterbed's mattress includes an elongate flexible elastic member having opposite first and second ends, the first end of which is attached to the fastening means. In addition, the positioning means includes a generally rigid retainer member having a first end which is attached to the second end of the flexible elastic member and a hook-shaped second end which is located at the opposite end of the retainer member. The hook-shaped end is adapted to receive the top edge of the waterbed liner which, in conventional waterbeds, terminates adjacent the top edge of the waterbed's frame. The hook-shaped end has a generally planer free end portion of substantial width for placement against the frame of the waterbed. The free end portion also defines holes through which screws or other fastening means are inserted to secure the retainer member to the waterbed frame. The retainer member also has a length which locates the first end of the retainer member proximate the bottom of the waterbed mattress, i.e. when the retainer member is secured to the waterbed frame over the edge of the waterbed liner. In addition, the elongate flexible member is provided with a length and is positioned with respect to the retainer member so that its first end attached to the fastener means is located near but below the top surface of the waterbed mattress when the retainer means is secured to the waterbed frame with its hook-shaped end receiving the top edge of the waterbed liner.

Additional advantages of this invention will become apparent from the description which follows, taken in conjunction with the accompanying drawings.

BEST MODE FOR CARRYING OUT THE INVENTION

Figure 1:
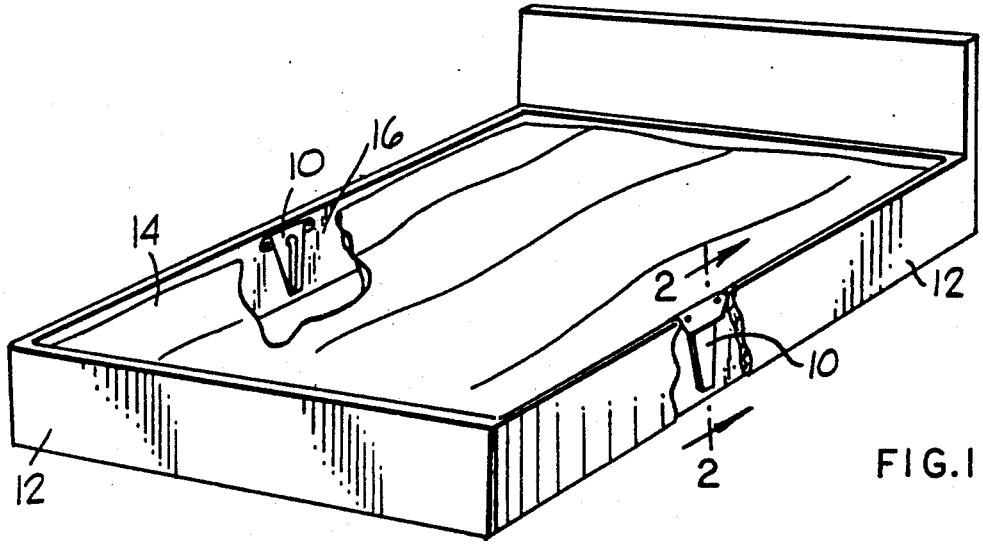
FIG. 1 is a perspective view of a waterbed which is broken away in two locations to show the bedding holding device of the present invention which is secured to the waterbed's frame and located over the top edge of the waterbed's liner.
Figure 2:
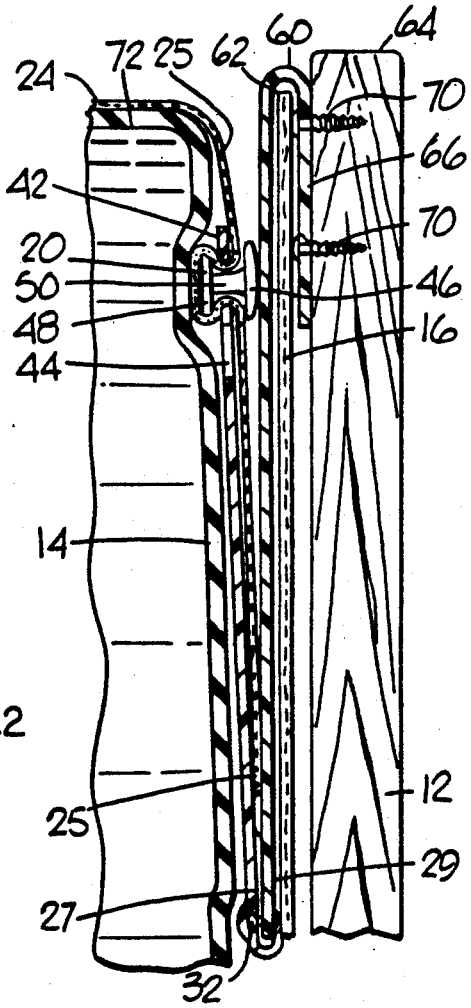
FIG. 2 is a cross-sectional view taken along lines 2—2 of FIG. 1.
Figure 3:
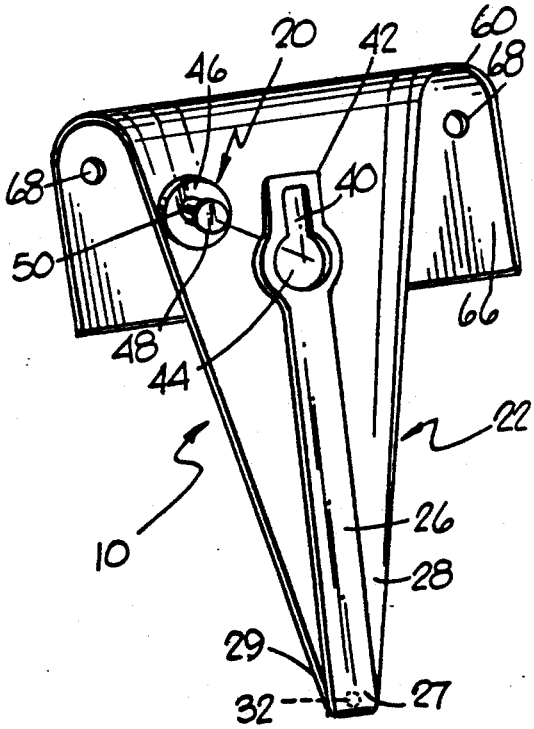
FIG. 3 is a perspective view showing the bedding holding device of FIG. 1 in isolation.

FIGS. 1 through 3 illustrate a device 10 for holding waterbed sheets nearly in place along the sides of a waterbed. As illustrated in FIG. 1, one device 10 is located along each side of the waterbed. The waterbed is of conventional construction and is provided with a box-like frame 12 which is made from wooden boards lying on edge and fastened together at the four corners of the frame. The waterbed frame 12 supports a fluid-filled mattress 14 which is essentially a water-filled flexible bag. In addition, the waterbed's frame 12 is lined with a waterproof plastic liner 16 which prevents fluid, typically water, from leaking out of the waterbed if the mattress begins leaking.

As best illustrated in FIGS. 2 and 3, device 10 in its broadest sense comprises two components, fastening means 20 and positioning means 22 which are capable of cooperating with one another to grippingly secure a waterbed sheet 24. FIG. 2 illustrates components 20 and 22 of device 10 grippingly securing an edge 25 of waterbed sheet 24.

Positioning component or means 22, as best illustrated in FIG. 3, also has two elements, an elongate flexible elastic member 26 and a generally rigid retainer member 28 which are attached to each other at their respective ends 27 and 29. End 27 of elastic member 26 has a button-like projection member 32 which secures elastic member 26 to retainer 28 by being inserted through a hole (not numbered) provided in the end 29 of retainer member 28. Flexible elastic member 26 is preferably made from an elastic but resilient material which enables it to elastically stretch when pulled.

FIGS. 2 and 3 also illustrate that elastic member 26 defines a longitudinal slot 40 at its other end 42. As best illustrated in FIG. 3, slot 40 has a generally circularly shaped enlargement 44 which is located at the end of the slot proximate end 27 of the elastic member.

Fastener means or stud 20, as best illustrated in FIGS. 2 and 3, has a head portion 46 which is connected to a base portion 48 by a neck 50. As illustrated, the diameter of neck 50 is small enough to enable it to slide through slot 40. As also illustrated, base portion 48 is small enough to pass through enlargement 44 but too large to pass through the remainder of slot 40. Head portion 46 is too large to pass through enlargement 44 or any portion of slot 40.

To grippingly secure a waterbed sheet located between stud 20 and slot 40, one first locates a sheet (such as sheet 24) over slot 40. Base portion 48 of stud 20 is then inserted into enlargement portion 44 of slot 40 until the underside of head portion 46 rests against the side of the elastic member 26 defining enlargement 44. The sheet is then secured between end 42 of the elastic member 46 and stud 20 by sliding stud 20 upwardly out of enlargement 44 into the narrower portion of slot 40. When in this position, the sheet is wrapped around the base portion 48 of the stud as illustrated, and thus is grippingly secured between stud 20 and end 42 of elastic member 26.

Turning now to retainer member 28, as shown in FIGS. 2 and 3, retainer member 28 has a hook-shaped end 60 which is located at the end of the retainer member opposite the retainer member's end 29. Hook-shaped end 60 is shaped or adapted to receive the top edge 62 (see FIG. 2) of watered liner 16. As illustrated, top edge 62 of liner 16 terminates near the top edge 64 of the waterbed's frame 12. Hook-shaped end 60 also has a generally planar free-end portion 66 of substantial width which is placed against the wooden frame of the waterbed as illustrated in FIG. 2. Free end portion 66 defines holes 68 as illustrated through which fastening means such as screws 70 are inserted to secure retainer member 28 against the waterbed's frame. As also illustrated in FIGS. 2 and 3, retainer member 28 is provided with a length extending from end 60 to end 29 which locates end 29 of the retainer member proximate the bottom of the waterbed mattress, i.e. when the retainer member is secured to the frame over top edge 62 of the waterbed liner. In addition, flexible member 26 is provided with a length which cooperates with the length of retainer member 28 so that the upper end 42 of the elastic member 26 is located below the top surface 72 of the waterbed mattress, i.e. when retainer member 28 is secured to the waterbed frame with its hook-shaped end 60 fully receiving the top edge 62 of the waterbed liner, as such is illustrated in FIG. 2.

As those skilled in the art will appreciate, by locating and end 42 of the elastic member below the top surface of the waterbed mattress, device 10 is capable of neatly holding a waterbed sheet on the mattress, i.e. tucked between the side of the waterbed mattress and the waterbed frame. It will also be appreciated that stud 20 and end 42 of the elastic member are kept out of sight by locating these elements below the mattresses surface 72. The only portion of the device which can possibly be seen, then, is the top edge of hook-shaped end 60 of the retainer member. While the appearance of this portion of the device may be objectionable to some, it will be appreciated that the retainer member can be manufactured in a number of desirable colors or wood-grain shades which will blend in with the frame of the waterbed so as to not even be noticeable.

Figure 4:
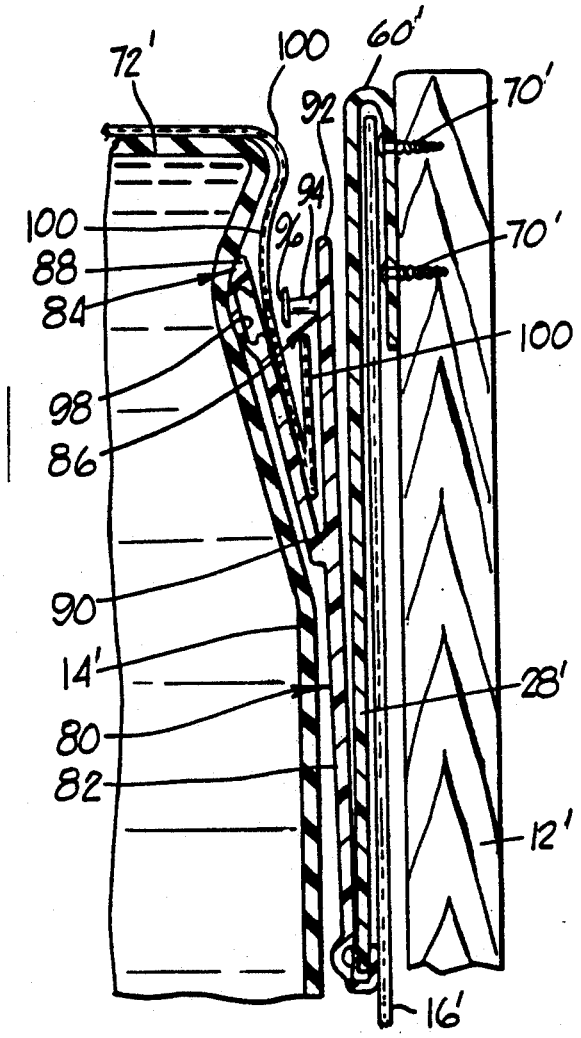
FIG. 4 is a cross-sectional view similar to that of FIG. 2 showing another embodiment of the present invention having different fastener means than that employed in the device of FIG. 1.
Figure 5:
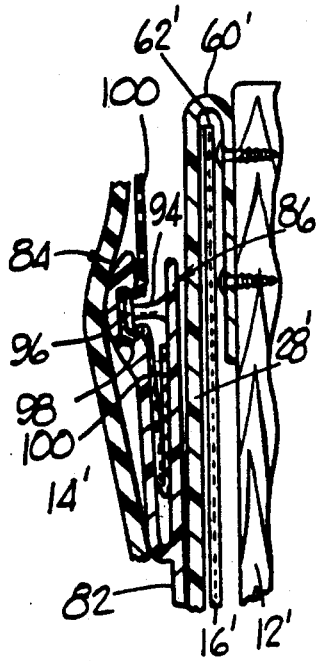
FIG. 5 is a cross-sectional view similar to that of FIG. 4 showing, however, the male and female portions of the fastener means snapped together to securely grip a bedsheet.

FIGS. 4 and 5 illustrate another device 80 of the present invention for holding waterbed sheets neatly in place on a waterbed. Those elements of device 80 which are identical to those of device 10 are numbered similarly with the exception that the numerals are primed. For example, retainer member 28' of device 80 is identical to retainer member 28 of device 10. Accordingly, all elements thereof are numbered similarly, but primed.

As shown, the components of device 80 which differ from those of device 10 include the elongate elastic member 82 and the fastener means (not numbered) which, as shown in FIGS. 4 and 5, are integral with each other. The fastener means includes female and male snap members 84 and 86, respectively, which are located at the free end (not numbered) of elastic member 82. Female snap member 84 has a free end 88 and a lower end 90 which is pivotally attached to a point on the mid-section of elastic member 82. The free end 92 of male snap member 86 defines a stud-like member 94 which terminates at a convex head portion 96. As also illustrated, female snap member 84 defines a concave depression 98 at its free end 88 for snappingly receiving convex head portion 96 of stud 94. Moreover, as illustrated in FIG. 5, head portion 96 and concave portion 98 are dimensioned to snappingly receive one another, even when a layer of bedsheet 100 is inserted therebetween. The depression and stud are also dimensioned to securely grip the sheet i.e. to prevent the sheet from being pulled out of depression and the stud when they are snappingly receiving each other. Device 80 may have more appeal than device 10 since the fastening means is integrally attached to elastic member 82 and therefore cannot be lost.

While not illustrated, elastic members 26 and 82 of devices 10 and 80 respectively could be adjustably attached to the lower ends 29, 29' of the retainer members 28, 28'. This would enable one to adjust the position of the fastening means relative to the top surface of the mattress. The ability to do this might be desirable if the waterbed sheets of the waterbed are particularly wide or long, i.e. it might be desirable to locate the fastener means closer to the bottom of the retainer member to take up "slack" bed sheet, i.e. the extra material of the oversized sheet.

The invention has been described in detail with reference to particular embodiments thereof, but it will be understood that various other modifications can be effected within the spirit and scope of this invention.

I claim:

1. A device for holding bedding neatly in place on a waterbed, the waterbed having a fluid-filled mattress supported within a frame structure which is lined with a waterproof plastic liner for preventing fluid from leaking out of the waterbed if the fluid-filled mattress begins leaking, said device comprising:

fastening means for gripping an edge portion of bedding for a waterbed; and means for positioning said fastener means at a location below the top surface of the fluid-filled mattress between the mattress and the waterbed liner, said positioning means being secured to the frame structure without piercing the waterproof plastic liner, said means for positioning further including flexible elastic means for elastically stretching when waterbed bedding gripped by said fastener means is pulled.

2. A device as claimed in claim 1 wherein said means for positioning includes:

an elongated flexible elastic member having opposite first and second ends, said first end cooperating with said fastener means to grip the waterbed bedding; and a generally rigid retainer member having a first end which is attached to said second end of said flexible elastic member, said retainer member also having a hook-shaped second end which is located at the opposite end of said retainer member, said hook-shaped end being adapted to receive the top edge of the waterbed liner which terminates adjacent the top edge of the waterbed's frame, said hook-shaped end also having a generally planer free end portion of substantial width for placement against the frame structure of the waterbed, said free end portion defining holes through which screw means are inserted to secure said retainer member to the waterbed's frame, said retainer member also having a length which locates said first end of said retainer member proximate the bottom of the waterbed mattress when said retainer member is secured to the waterbed frame over the edge of the waterbed liner;

said elongate flexible member also having a length and being positioned with respect to said retainer member so that its first end attached to said fastener means is located proximate, but below the top surface of the waterbed mattress when said retainer member is secured to the waterbed frame with its hook-shaped end receiving the top edge of the waterbed liner.

3. A device for holding bedding neatly in place on a waterbed having a fluid-filled mattress supported within a waterbed frame structure, the frame structure including a generally wooden frame and a waterproof plastic liner for lining the inner facing surfaces of the wooden frame and for preventing fluid from leaking from the waterbed if the mattress begins leaking, the device comprising:

fastener means for gripping an edge portion of bedding for a waterbed;

an elongate member having opposite first and second ends, said first end being attached to said fastener means;

a retainer member having a first end which is attached to said second end of said elongate member, said retainer member also having a hook-shaped second end which is located at the opposite end of said retainer member, said hook-shaped end being adapted to receive the top edge of the waterbed liner which terminates adjacent the top edge of the waterbed's frame, said hook-shaped end also having a generally planer free end portion of substantial width for placement against the wooden frame of the waterbed, said retainer member also having a length which locates said first end of said retainer member proximate the bottom of the waterbed mattress when said retainer member is secured to the waterbed frame over the edge of the waterbed liner;

said elongate member also having a length and being positioned with respect to said retainer member so that its first end attached to said fastener means is located proximate, but below the top surface of the waterbed mattress when said retainer member is secured to the waterbed frame with its hook-shaped end receiving the top edge of the waterbed liner.

4. A device as claimed in claim 3 wherein said first end of said elongate member defines a longitudinal slot having an enlargement located at the end of said slot proximate said second end of said elastic member and wherein said fastener means has a head portion too large to pass through said enlargement of said slot, a base portion small enough to pass through said enlargement, but too large to pass through the remainder of said slot, and a neck interconnecting said head and said base for sliding through said slot.

5. A device as claimed in claim 3 wherein said fastener means and said elongate member are integral with each other, said fastener means being disposed at said first end of said elongate member, said fastener means including male and female elongate snap members, each of which has an upper end and a lower end, said male and female snap members being pivotally connected together at their lower ends, said upper end of said male member having a stud-shaped outwardly projecting member, said stud terminating at a convex head portion, said female member defining a concave depression at its upper end for snappingly receiving said convex head portion of said stud when a single layer of bed sheet material is inserted between said depression and said stud so that said bed sheet material is capable of being securely gripped by said male and female members.

* * * * *